United States Patent [19]

Kuhn et al.

[11] Patent Number: 4,617,096

[45] Date of Patent: Oct. 14, 1986

[54] BATH AND PROCESS FOR THE ELECTROLYTIC DEPOSITION OF GOLD-INDIUM ALLOYS

[75] Inventors: Werner Kuhn, Rodenbach; Wolfgang Zilske, Hanau, both of Fed. Rep. of Germany

[73] Assignee: Degussa Aktiengesellschaft, Frankfurt am Main, Fed. Rep. of Germany

[21] Appl. No.: 823,293

[22] Filed: Jan. 28, 1986

[30] Foreign Application Priority Data

Feb. 6, 1985 [DE] Fed. Rep. of Germany ..... 3505473

[51] Int. Cl.[4] ..... C25D 3/62

[52] U.S. Cl. ..... 204/44.3

[58] Field of Search ..... 204/44.3, 123, 47.5

[56] References Cited

U.S. PATENT DOCUMENTS 3,990,954 11/1976 Foulke et al. ..... 204/47.5
4,391,679 7/1983 Zilske et al. ..... 204/44.3

FOREIGN PATENT DOCUMENTS 1111897 7/1961 Fed. Rep. of Germany ..... 204/44.3
3012999 10/1981 Fed. Rep. of Germany ..... 204/44.3

*Primary Examiner*—G. L. Kaplan
*Attorney, Agent, or Firm*—Cushman, Darby & Cushman

[57] ABSTRACT

Light yellow, glossy and ductile gold-indium alloys which have a good resistance to gradual corrosion by silver sulfide are obtained from electrolytic (galvanic) baths containing 1 to 20 g/l of gold in the form of alkali or ammonium tetracyanoaurate (III), 0.5–50 g/l of indium in the form of a water soluble indium salt, a buffer or conducting salt and 0.5 to 10 mg/l of selenium and/or tellurium.

18 Claims, No Drawings

BATH AND PROCESS FOR THE ELECTROLYTIC DEPOSITION OF GOLD-INDIUM ALLOYS

BACKGROUND OF THE INVENTION

The invention is directed to a bath for the electrolytic (galvanic) deposition of gold-indium alloy coatings at a pH of less than 3 consisting of (or consisting essentially of) 1 to 20 grams/l of gold in the form of alkali and/or ammonium tetracyanoaurate (III), 0.5 to 50 g/l of indium in the form of a water soluble indium salt, an acid and a buffer or conducting salt.

The co-deposition of indium from electrolytic gold electrolytes leads to light yellow gold coatings which above all are used in the decorative industry in gold plating watch cases, arm bands, eyeglass frames, or jewelry. In addition to good general corrosion resistance in comparison to other gold alloy coatings, the coatings have an especially good resistance to the gradual corrosion by silver sulfide. The gold-indium alloy coatings which deposit from weakly acid baths at pH 3.5–5 (e.g. German Pat. No. 1111897) are characterised by great brittleness and are inclined to the formation of fissures through which the resistance to corrosion is greatly impaired. Therefore indium is deposited together with other metals such as nickel or cobalt which impair the resistance to gradual corrosion by silver sulfide. The indium content in the coating is only about 1%.

According to German Pat. No. 3,012,999 (and related Zilske U.S. Pat. No. 4,391,679, the entire disclosure of which is hereby incorporated by reference and relied upon) the co-deposition of indium from a strongly acid gold electrolyte based on potassium tetracyanoaurate (III) is possible. Under the stated conditions ductile non-glossy coatings are obtained, but no glossy coatings are obtained with indium contents of 2–3%. By the addition of a nickel or cobalt salt to the electrolyte it is true that a glossy coating deposits, which, however, has a relatively strong gray appearance. A light yellow color tone is not produced. Besides in this case the resistance to gradual corrosion is also reduced.

These baths contain 1 to 20 g/l of gold in the form of tetracyanoaurate (III), a water soluble alloying metal salt, an acid and a complex former at a pH between 0.4 and 2.5.

SUMMARY OF THE INVENTION

Therefore it was the task of the present invention to develop a bath for the electrolytic deposition of gold-indium alloy coatings at a pH below 3 consisting of (or consisting essentially of) 1 to 20 g/l of gold in the form of alkali (e.g. sodium or potassium) and/or ammonium tetracyanoaurate (III), 0.5 to 50 g/l of indium in the form of a water soluble indium salt, an acid and a buffer or conducting salt which yields light yellow, glossy and ductile coatings on a base metal without impairing the gradual resistance to gradual corrosion by silver sulfide.

This problem is solved according to the invention by additionally including in the bath 0.5 to 10 mg/l of selenium and/or tellurium in the form of selenious or tellurous acid and/or alkali selenite or tellurite, e.g. sodium selenite, potassium selenite, sodium tellurite, potassium tellurite.

Preferably the bath contains the indium in the form of indium sulfate and as the acid there is used sulfuric acid. (However, other indium salts can be used, e.g. indium chloride or bromide and other acids, e.g. hydrochloric acid or hydrobromic acid). Furthermore, it has proven advantageous to employ as the buffer or conducting salt, ammonium sulfate, sulfamic acid, aliphatic and/or sulfonic acid, e.g. methanesulfonic acid, ethanesulfonic acid, benzenesulfonic acid, toluenesulfonic acid. Especially there has proven good a mixture of 10 to 150 g/l of ammonium sulfate with 10 to 150 g/l of sulfamic acid, toluenesulfonic acid and/or 2-hydroxyethanesulfonic acid.

Preferably the bath is operated at a pH between 0.4 and 2.5, a temperature between 20 and 70° C. and a current density of 0.2 to 5 A/dm$^2$, especially a temperature between 50° and 60° C. and a current density between 1 and 3 A/dm$^2$.

The selenium or tellurium compound contained in the bath not only causes the deposition of a high gloss coating but also acts to an unexpected degree positively on the other bath and coating properties. Thus it is possible to deposit gold-indium alloy coatings having at least 10 wt.% indium which are light yellow and in the color scale according to DIN 8238 (German Industrial Standard 8238) are between 0 and 1N.

Furthermore, it was surprising that the current yield of the baths considering the indium portions amounts to nearly 100% while without addition of selenium or tellurium there are obtained only current yields between 10 and 20%, depending on both temperature, current density and gold content.

In spite of the high indium contents the coatings are very ductile and can be isolated as stable films.

Besides they are resistant against gradual corrosion by silver sulfide, i.e. with silver or a silver layer as underlayer silver sulfide does not spread out on the covering gold-indium layer.

Additionally the use of a suitable sulfonic acid is advantageous. In comparison to a pure sulfate bath there are obtained glossy coatings in a broad current range.

The invention will be explained in detail in the following examples.

The process can consist essentially of or consist of the stated steps with the recited materials.

DETAILED DESCRIPTION

EXAMPLE 1

A bath was produced by dissolving the following components:

9.1 grams of indium sulfate were dissolved in about 100 ml of water and 12 ml of sulfuric acid (98%) by heating. After diluting to about 500 ml there were added and dissolved 50 grams of ammonium sulfate and 50 grams of the sodium salt of hydroxyethanesulfonic acid as well as 3.2 mg of selenious acid.

After addition of 13.8 grams of potassium tetracyanoaurate (III) the composition was diluted to 1 liter and the pH adjusted with sulfuric acid or ammonia solution to 1.1. There was deposited at a current density of 2A/dm$^2$ in 14 minutes a 5 $\mu$m thick glossy, pale yellow gold alloy coating on a cathode made of a polished copper sheet which was in the bath that had been heated to 55° C. The coating contained 9.8% In. The copper support was dissolved with 3:1 diluted nitric acid and there remained behind a ductile gold film which did not break even with sharp bending.

EXAMPLE 2

Corresponding to Example 1 there was prepared a bath made of the following components:

| | |
|---|---|
| Indium sulfate | 18.2 g/l |
| Ammonium sulfate | 100 g/l |
| Sulfamic acid | 75 g/l |
| Selenious acid | 6.5 mg/l |
| Potassium tetracyano-aurate (III) | 18.8 g/l |

The pH was adjusted to 1.0 and the bath heated to 60° C. A 2.8 μm thick gloss gold alloy coating containing 11 wt.% indium was deposited on a shining nickel plated copper sheet at a current density of 3 A/dm$^2$ in 5 minutes.

EXAMPLE 3

Corresponding to the procedure in Example 1 a bath was produced from the following components:

| | |
|---|---|
| Indium sulfate | 9.1 g/l |
| Ammonium sulfate | 50 g/l |
| Toluenesulfonic acid | 50 g/l |
| Potassium tellurite | 6.3 mg/l |
| Potassium tetracyano-aurate (III) | 13.8 g/l |

The pH was adjusted to 1.3. A 2.7 μm thick glossy gold alloy coating containing 9.1% indium was deposited on a cathode made of a glossy nickel plated copper sheet at a current density of 1 A/dm$^2$ in 10 minutes.

The entire disclosure of German priority application No. P 3505473.5 is hereby incorporated by reference.

What is claimed is:

1. A bath suitable for the electrolytic deposition of a gold-indium alloy coating at a pH below 3 consisting essentially of water, 1 to 20 g/l gold in the form of at least one member of the group consisting of alkali and ammonium tetracyanoaurates (III), 0.5 to 50 g/l indium in the form of a water soluble indium salt, in acid, a buffer or conducting salt and 0.5 to 10 mg/l of at least one member of the group consisting of selenium and tellurium, in the form of selenious acid, telluric acid, an alkali selenite or an alkali tellurite.

2. A bath according to claim 1 consisting of the recited materials.

3. A bath according to claim 1 wherein the indium is in the form of indium sulfate and the acid includes sulfuric acid.

4. A bath according to claim 3 wherein the buffer or conducting salt is at least one member of the group consisting of ammonium sulfate, sulfamic acid, an aliphatic sulfonic acid and an aromatic sulfonic acid.

5. A bath according to claim 4 containing 10 to 150 g/l of at least one member of the group consisting of sulfamic acid, toluenesulfonic acid and 2-hydroxyethane-sulfonic acid.

6. A bath according to claim 5 having a pH of 0.5 to 2.5.

7. A bath according to claim 4 having a pH of 0.5 to 2.5.

8. A bath according to claim 3 having a pH of 0.5 to 2.5.

9. A bath according to claim 1 wherein the buffer or conducting salt is at least one member of the group consisting of ammonium sulfate, sulfamic acid, an aliphatic sulfonic acid and an aromatic sulfonic acid.

10. A bath according to claim 9 containing 10 to 150 g/l of at least one member of the group consisting of sulfamic acid, toluenesulfonic acid and 2-hydroxyethane-sulfonic acid.

11. A bath according to claim 10 having a pH of 0.5 to 2.5.

12. A bath according to claim 9 having a pH of 0.5 to 2.5.

13. A bath according to claim 1 having a pH of 0.5 to 2.5.

14. A process of depositing a light yellow, glossy and ductile gold-indium alloy coating on a base metal comprising employing the gold bath of claim 1 with an electric current.

15. A process of depositing a light yellow, glossy and ductile gold-indium alloy coating on a base metal comprising employing the gold bath of claim 3 with an electric current.

16. A process of depositing a light yellow, glossy and ductile gold-indium alloy coating on a base metal comprising employing the gold bath of claim 4 with an electric current.

17. A process of depositing a light yellow, glossy and ductile gold-indium alloy coating on a base metal comprising employing the gold bath of claim 10 with an electric current.

18. A process of depositing a light yellow, glossy and ductile gold-indium alloy coating on a base metal comprising employing the gold bath of claim 11 with an electric current.

* * * * *